US009453369B1

(12) United States Patent
Green

(10) Patent No.: US 9,453,369 B1
(45) Date of Patent: Sep. 27, 2016

(54) LINEAL RETAINER PORCH SCREENING APPARATUS

(71) Applicant: Marhaygue, LLC, Pawleys Island, SC (US)

(72) Inventor: Guerry E. Green, Georgetown, SC (US)

(73) Assignee: Marhaygue, LLC, Pawleys Island, SC (US)

( * ) Notice: Subject to any disclaimer, the term of this patent is extended or adjusted under 35 U.S.C. 154(b) by 0 days.

(21) Appl. No.: 15/041,345

(22) Filed: Feb. 11, 2016

(51) Int. Cl.
*E06B 9/52* (2006.01)
*E04H 15/64* (2006.01)

(52) U.S. Cl.
CPC ..... *E06B 9/52* (2013.01); *E04H 15/644* (2013.01)

(58) Field of Classification Search
CPC ..... E06B 2009/005; E06B 2009/2423; E06B 2009/527; E06B 3/30; E04H 15/642; E04H 15/644; E04F 10/0633
USPC ..... 52/63, 202, 222, 656.5, 656.6, 656.7; 160/179, 392, 395
See application file for complete search history.

(56) References Cited

U.S. PATENT DOCUMENTS 917,726 A * 4/1909 Fulton ..... E06B 9/52 160/395
974,380 A * 11/1910 Hoagland ..... E06B 9/52 160/21
2,381,029 A * 8/1945 Beil ..... E06B 9/52 160/395
3,187,801 A * 6/1965 Saling ..... E06B 3/28 160/371
3,273,633 A * 9/1966 Seidmon et al. ..... A47K 3/30 101/127.1
3,811,454 A * 5/1974 Huddle ..... E04H 15/42 135/119
4,071,990 A * 2/1978 Traber ..... B44C 7/022 403/231
4,193,235 A * 3/1980 Cucchiara ..... E06B 3/285 160/380
4,817,655 A * 4/1989 Brooks ..... E04H 15/58 135/119
4,899,797 A 2/1990 Green
5,046,546 A * 9/1991 Benedyk ..... E06B 9/521 160/371
5,224,306 A * 7/1993 Cramer ..... E04H 5/02 135/121
5,737,885 A * 4/1998 Stoyke ..... E06B 3/28 52/202
6,036,398 A * 3/2000 Theodorou ..... E04F 11/181 403/290
6,295,783 B1 * 10/2001 Davis ..... E04C 3/30 52/236.1
6,338,226 B1 * 1/2002 Gauthier ..... A01G 9/14 47/17
6,412,250 B2 * 7/2002 Davis ..... 52/236.1
6,945,305 B1 * 9/2005 Limauro ..... E06B 9/52 160/369
7,165,690 B2 * 1/2007 Wu ..... A47B 96/1466 211/187
7,222,467 B2 5/2007 Nowell et al.
7,526,902 B2 5/2009 Green
7,861,473 B1 1/2011 Green
8,042,598 B2 10/2011 Bredemus et al.
8,051,868 B2 * 11/2011 Whitlow ..... E04H 15/18 135/120.3
8,056,602 B1 11/2011 Green
2002/0017072 A1 * 2/2002 Davis ..... E04C 3/30 52/834
2005/0210777 A1 * 9/2005 Baughn ..... E06B 3/9682 52/202
2005/0235585 A1 * 10/2005 Green ..... E06B 9/52 52/204.5
2006/0086684 A1 * 4/2006 Wu ..... A47B 96/1466 211/192
2006/0231221 A1 * 10/2006 Chen ..... E06B 9/52 160/392
2008/0289278 A1 * 11/2008 Green ..... E06B 3/285 52/474
2008/0289780 A1 * 11/2008 McGregor ..... D03D 9/00 160/371
2009/0159222 A1 * 6/2009 Moriya ..... E06B 9/52 160/378
2009/0230257 A1 * 9/2009 Reyen ..... E04H 15/18 248/74.2
2010/0212710 A1 * 8/2010 Roder ..... E04C 3/29 135/121

* cited by examiner

*Primary Examiner* — Robert Canfield
(74) *Attorney, Agent, or Firm* — Michael A. Mann; Nexsen Pruet, LLC

(57) ABSTRACT

A lineal retainer kit for facilitating the covering of openings defined by porch framing with mesh screening and a second material. The primary components of the kit are a lineal retainer, two splines for the two opposing grooves in the lineal retainers, a cap, and fasteners to hold the lineal retainers to the framing, and possibly also including mesh screening material. The lineal retainers use opposing grooves and splines to hold two different coverings, such as mesh screening and plastic film or a fabric, at the same time. In particular, the kit enables homeowners or contractors to tailor the environment of a porch to better meet the homeowner's needs by providing an easy way to add shade, privacy, ultraviolet light protection, or a different aspect of the porch decor.

13 Claims, 5 Drawing Sheets

LINEAL RETAINER PORCH SCREENING APPARATUS

TECHNOLOGICAL FIELD

The technological field of the disclosure is residential construction and more particularly, construction of screened-in porches.

BACKGROUND

A porch is the extension of a house that is most exposed to the weather. A porch may be covered by a roof and is often enclosed by mesh screening attached to a framework. Porches can be comfortable much of the year in temperate climates. If the weather turns cold or windy and wet, then the comfort level decreases accordingly. Many homeowners tack plastic sheeting over the mesh screening of a screened-in porch during winter months may make the porch a little more comfortable.

Having a porch open on several sides may not be desirable even in warmer times of the year depending on the desire for privacy, the view, and perhaps the direction of the sun. For example, if adjacent homes are close, perhaps the view to the area behind the porch is agreeable but the view to the sides may simply underscore the closeness of adjacent homes. As another example, a porch with an eastern or western exposure may result in bright, hot morning or afternoon sun flooding the porch, making it uncomfortable despite otherwise moderate air temperatures.

Having the capability to modify the exposure of one or more sides of a porch by decreasing sunlight, providing protection from ultraviolet sunlight, weatherizing a porch, and adding a modicum of privacy would be an advantage.

SUMMARY

According to its major aspects, the present disclosure presents a lineal retainer kit for solving the afore-described problems. A lineal retainer kit is a system of components that cooperate together to achieve this desired result. The primary components of the kit are a lineal retainer, two splines, a cap and fasteners. The kit may also include mesh screening. In particular, the kit provides the infrastructure to enable homeowners or contractors to tailor the environment and appearance of a porch to meet the homeowner's individual requirements.

A feature of the disclosure is the Homeowners may apply a covering to just one side or to both sides. Mesh covering may be left up all year; a plastic film may be put up in colder months as a cost effective way to winterize the porch and provide a greenhouse effect, keeping the porch warmer for outdoor plants and seedlings than if they were exposed to cold winds and frost. Putting up a covering and taking it down can be done quickly and simply by removing the splines temporarily until the change is made.

Another feature of the disclosure is that the present lineal retainer kit can be used with greenhouses, with a covering of mesh or bird netting on one side and plastic on the other.

A feature of the disclosure is a lineal retainer with grooves on two opposing sides and with a third groove on the side adjacent to both of the opposing sides. There are two splines, one for each of the two opposing grooves and a cap that covers the third groove. The splines for the opposing grooves hold mesh screens or sheeting, such as plastic film or fabric, in place.

The long dimension of the lineal retainer defines a major axis and the grooves formed in the lineal retainer run parallel to this axis. Each grooved side of the lineal retainer has a face. When the splines are in place in their respective grooves holding the mesh screen or sheeting in place and the cap is in place in the third groove, the splines and cap will all be flush with the faces of their respective sides of the lineal retainer, for a trim appearance.

A feature of the disclosure is that the two opposing grooves and splines can be used to secure two materials covering the opening defined by the framing at the same time, such as screen mesh and plastic sheeting, or screen mesh and a fabric. The sheeting may provide shade, protection from wind or UV rays, noise reduction, and privacy, and may also be used to enhance the appearance of the house or the décor of the porch.

Another aspect of the disclosure is the splines. The splines may be flat splines and used when the two opposing grooves are flat spline grooves, or they may be U-shaped splines that fit into rectangular grooves, wherein each U-shaped spline has two opposing walls that engage the two opposing sides of a groove. The corresponding rectangular groove and the U-shaped spline may be configured to resist removal of the spline from the groove, such as by use of ribs and grooves formed in them and running parallel to the major axis of the lineal retainer on the sides of the groove and the corresponding walls of the spline.

An aspect of the disclosure is the third groove which may be V-shaped or may have a V-shaped notch in its bottom surface to facilitate accurate centering of each fastener of a row of fasteners, such as screws, to pass through the center of the V and also through the major axis of the lineal retainer and thence into the framing.

Those skilled in porch construction will appreciate other features from a careful reading the detailed description below, accompanied by the drawings.

BRIEF DESCRIPTION OF THE DRAWINGS

In the figures.

DETAILED DESCRIPTION

The term lineal is used in connection with windows to refer to trim pieces that are relatively long, thin pieces made of wood or extruded vinyl. As used therein, the term lineal retainer is intended to refer to a relatively long, relatively thin piece intended to be used with the openings of porch framing to retain, or hold, screening and sheeting. Lineals in windows unify and accent the exterior around a window as a secondary consideration. The term is used as a secondary consideration in the same way here, namely, for a component used to unify and accent the window. The lineal retainer, together with the other kit components, is primarily intended for holding mesh screens and sheeting in place as window coverings.

The term kit refers to a group of individual elements that may be provided together or used together to achieve a specific result, herein, covering the opening defined by the framing of the porch. Because porches are not standardized, of course, lineal retainers, splines, caps, mesh screening and sheeting will need to be cut to fit. Generally, the length of lineal retainer, cap, splines, and the number of fasteners in a kit or sold together for use will bear a relationship with each other that is closely related to the total length of the perimeters of the openings in the framing of a porch.

Figure 1:
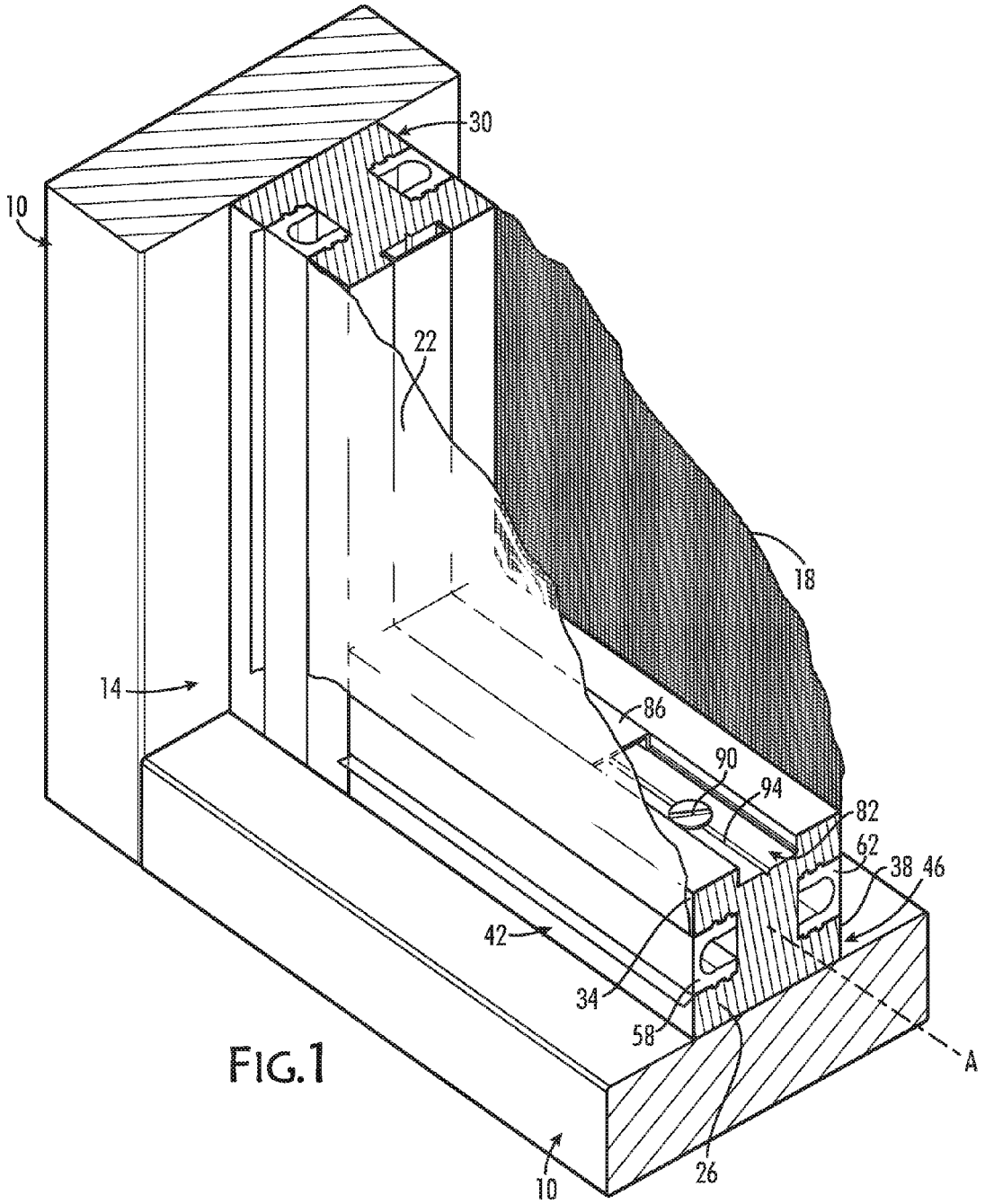
FIG. 1 is a perspective, partially cutaway view of the present lineal retainer kit installed and in use, according to an aspect of the disclosure.

Referring now to the figures, FIG. 1 shows the present lineal retainer kit installed in an opening defined by framing 10. A porch is constructed by framing in the perimeter of the porch using horizontal and vertical posts and rails, collectively, herein referred to as framing 10. Framing 10 may be formed from standard sizes of lumber secured together to have vertical posts and horizontal rails. Framing 10 defines openings 14 in the framing between posts and rails.

Openings 14 are then covered by mesh screening. Mesh screening are made of loosely woven strands of a wire-like material which may be fiberglass or aluminum. Other materials can also be used, including netting. In FIG. 1, a mesh screen 18 is shown covering opening 14. A sheet 22 of plastic or textile is shown covering the opening in a plane parallel to mesh screen 18. Both are held fast by the same pair of lineal retainers 26, 30, with lineal retainer 26 oriented horizontally and lineal retainer 30 being vertically oriented. Hereinafter, because lineal retainer 26 is identical to lineal retainer 30 except for orientation, reference to lineal retainer 26 will be understood as applying to lineal retainer 30. Lineal retainer 26 may be straight cut or miter cut from a longer lineal retainer 26 to the desired length using a saw or miter box or other stable cutting platform and cutting tool.

Figure 2:
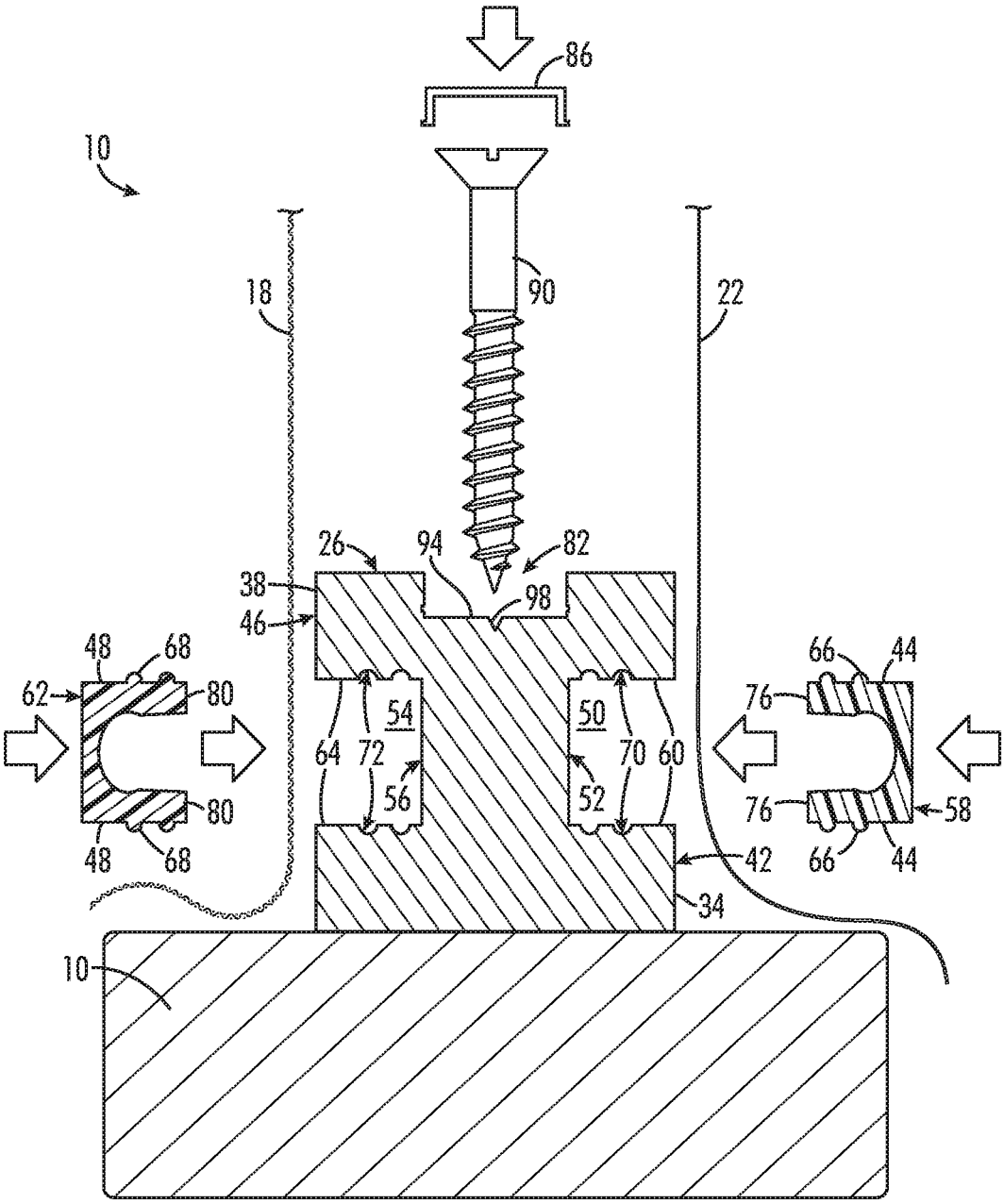
FIG. 2 is an exploded end view of the lineal retaining kit, according to an aspect of the disclosure.

As best seen in FIG. 2, lineal retainer 26 has a first and an opposing second side 34, 38. Each side 34, 38 has a face 42, 46, exposed on one side or the other of opening 14. First and second grooves 50, 54, are formed in first and second sides 34, 38, respectively. A first and a second spline 58, 62, are seated in first and second grooves 50, 54. The long dimension of lineal retainer 26 defines a major axis A, and first and second grooves 50, 54 run parallel to major axis A. Splines 58, 62 also run parallel to major axis A and are more or less coaxial with grooves 50, 54.

Figure 3:
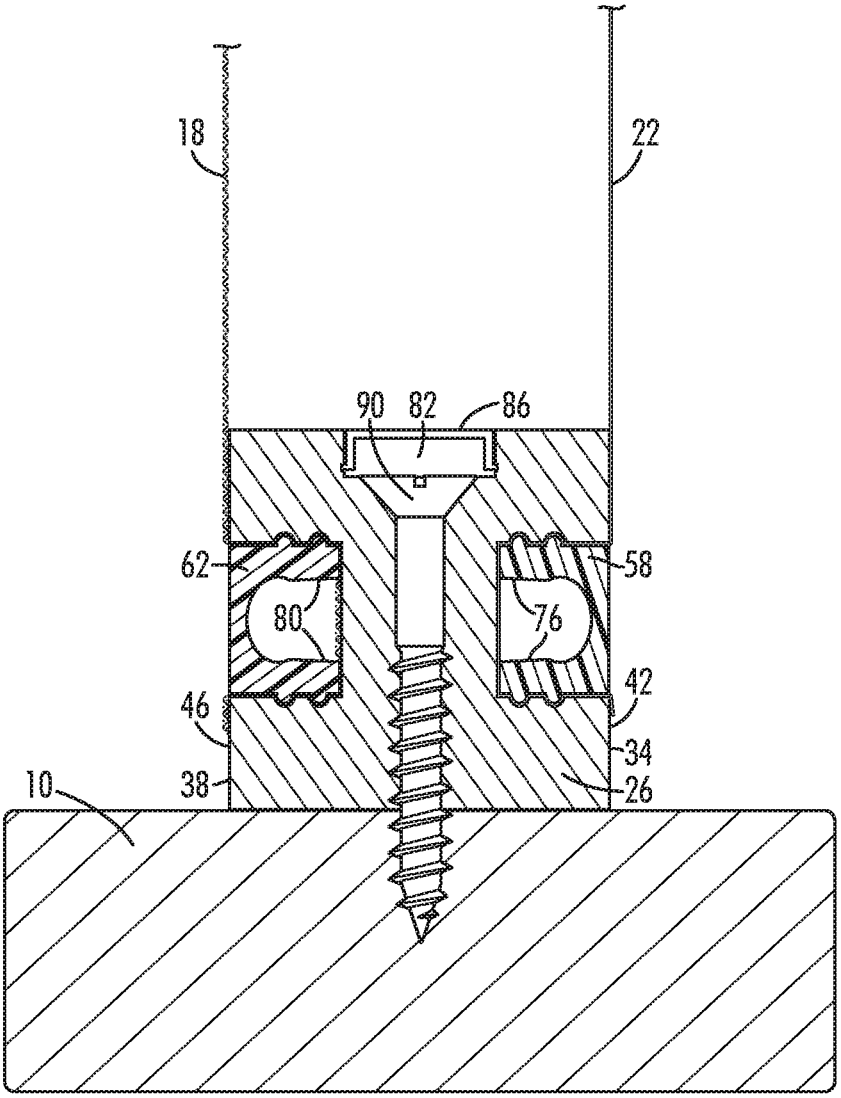
FIG. 3 is an assembled end view of the lineal retaining kit, according to an aspect of the disclosure.

First and second grooves 50, 54, may have the same shape or may have different shapes. Primarily, they must be capable of holding a spline such as splines 58, 62, in place and, together with the spline, hold the marginal portion of mesh screen 18 or sheet 22. In FIGS. 1-3, first and second splines 58, 62, are illustrated as having the same, generally rectangular U-shape but they may, in the alternative, be different.

Splines 58, 62, are made of a resilient material such as natural or synthetic rubber, to assist in installing them in grooves 50, 54. As seen in FIG. 2, especially, grooves 50, 54, are essentially rectangular grooves with flat bottoms 52, 56, and opposing flat sides 60, 64, perpendicular to bottoms 52, 56, respectively. Splines 58, 62 are shown as having an exterior shape of a rectangular solid but are U-shaped with two walls 44, 48, and two legs 76, 80, when viewed along major axis A (identified in FIG. 1).

Splines 58, 62, when seated in grooves 50, 54, present a flat, smooth appearance from the exterior of lineal retainer 26, may be configured to resist removal from grooves 50, 54. For example, by forming a combination of ribs and grooves on walls 44, 48, and sides 60 64, parallel to the major axis A of lineal retainer 26, the interlocking of ribs and grooves will resist lateral movement of splines 58, 62. As best seen in FIGS. 2 and 3, ribs 66, 68, on splines 58, 62 and grooves 70, 72, on grooves 50, 54, are easily formed when lineal retainer 14 and splines 58, 62 are extruded. Other variations of ribs and grooves and mixes of ribs and grooves are also possible.

Splines 58, 62, because of their U-shape and the resilient material of which they are made can be easily inserted into grooves 50, 54, by squeezing legs 76, 80, together, and inserting them first into grooves 50, 54. When legs 74, 78, are released, they spring apart. The ribs 66, 68, on walls 44, 48, of splines 58, 62, slip into the grooves 70, 72, respectively, of grooves 50, 54, to thereafter resist removal of splines 58, 62. Splines 58, 62, may be nonetheless be removed from grooves 50, 54, respectively, because of their resilience if sufficient force is used. Ribs 66, 68, and grooves 70, 72, merely require intentional effort for their removal and are not removed, for example, as the result of, say, wind blowing on sheet 22.

Third groove 82 and cap 86 hide fasteners 90 from the exterior when cap 86 is fitted in third groove 82. Fasteners 90 can be screws or nails dimensioned to pass from third groove 82 through lineal retainer 14 and into framing 10 far enough to hold lineal retainer 14, splines 58, 62 and mesh screen 18 and sheet 22 even against brisk winds. Third groove 82 may be V-shaped or have a V-notch 94 cut in its floor 98 to identify and facilitate locating and driving of fastener 90 into lineal retainer 14 and framing 10. Fastener 90 should pass from V-notch 94 of third groove 82 through major axis A. Alternatively, holes can be pre-drilled into lineal retainer 14, When fastener 90 is seated in third groove 82, cap 86 can be set in place so no fastener 90 is exposed.

The lineal retainer which may be about 4 cm (1.5 inches) square, may be extruded of plastic such as PVC or aluminum in various colors, and the framing to which it attached may have a finish that matches or complements the color of the lineal retainer. Likewise the cap may be extruded PVC or aluminum in the same color and the spline may be made of synthetic rubber in any suitable color. If made of extruded plastic PVC, the plastic may be solid, foamed, or hollow PVC.

Figure 4:
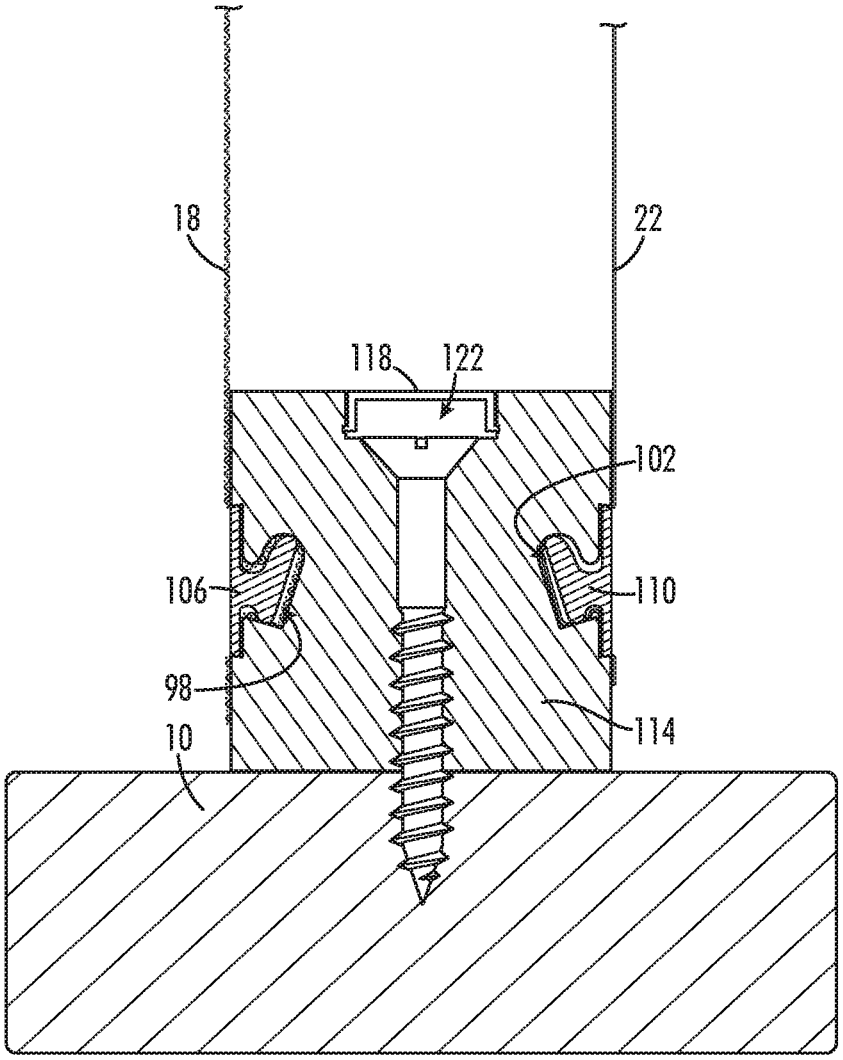
FIG. 4. is an alternative embodiment of the lineal retaining kit, according to an aspect of the disclosure.

FIG. 4 illustrates an alternative embodiment of the disclosure, namely, a retainer 114 having flat spline grooves 98, 102, that receive flat splines 106, 110. A cap 118 covers a third groove 122.

Figure 5:
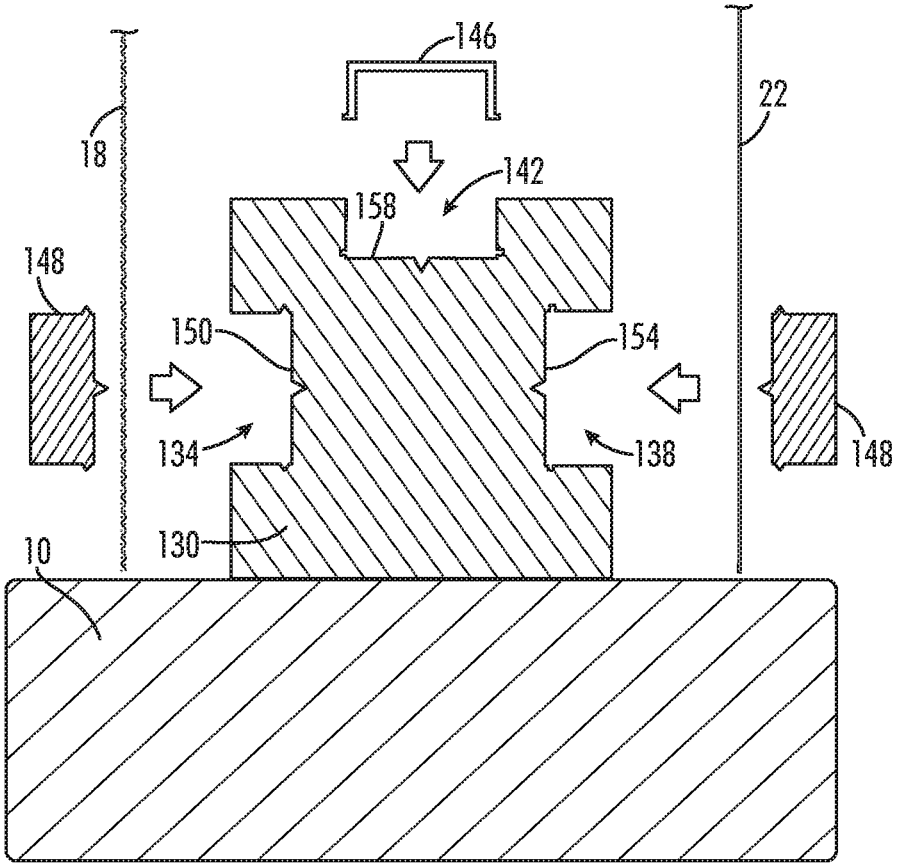
FIG. 5 illustrates a second alternative embodiment of the lineal retainer and cap, according to an aspect of the disclosure.

FIG. 5 illustrates a second alternative embodiment of the disclosure in a lineal retainer 130 with three grooves: two spline grooves 134, 138, and one cap groove 142. Grooves 134, 138, 142 are identical, and a cap 146 made of solid PVC or similar plastic may also serve as a spline. Each groove 134, 138, 142, flares near its respective bottom 150, 154, 158, and spline 148 has a complementary shape that extends into the flare of bottom 150, 154, 158, respectively. Spline 148 may be made of solid or foamed PVC. The two spline-receiving grooves need not be identical but may be different and their splines configured accordingly.

When introducing elements of the present disclosure or exemplary aspects or embodiment(s) thereof, the articles "a," "an," "the" and "said" are intended to mean that there are one or more of the elements. The terms "comprising," "including" and "having" are intended to be inclusive and mean that there may be additional elements other than the listed elements. Although this disclosure has been described with respect to specific embodiments, the details of these embodiments are not to be construed as limitations.

What is claimed is:

1. An apparatus for use with framing, said apparatus comprising:

screen mesh having a marginal portion;

a lineal retainer having a major axis, a first side with a first groove, a second side with a second groove, and a third side with a third groove, wherein said second side opposes said first side, and wherein said first groove, said second groove and said third groove are parallel to said major axis;

plural fasteners driven into said framing through said lineal retainer from said third groove of said third side and between said first groove and said second groove;

a first spline in said first groove with said marginal portion of said screen mesh between said first spline and said lineal retainer; and a second spline in said second groove.

2. The apparatus of claim 1, further comprising a sheet of plastic having a marginal portion and wherein said marginal portion of said sheet of plastic is in said second groove between said second spline and said lineal retainer.

3. The apparatus of claim 1, wherein said third groove has a floor with a v-shaped groove formed therein.

4. The apparatus of claim 1, wherein said lineal retainer is made of extruded polyvinylchloride or aluminum.

5. The apparatus of claim 1, further comprising a cap covering said third groove of said lineal retainer.

6. The apparatus of claim 5, wherein when said cap is flush with said third side.

7. The apparatus of claim 1, further comprising a textile having a marginal portion, said marginal portion of said textile being secured in said second groove by said second spline.

8. The apparatus of claim 1, wherein said third groove is identical to said first groove.

9. The apparatus of claim 1, wherein said first and said second grooves are identical.

10. The apparatus of claim 1, wherein said first and said second splines are identical.

11. The apparatus of claim 1, wherein said first spline has two opposing walls, said first groove has two opposing sides, said second spline has two opposing walls and said second groove as two opposing sides, and wherein said two opposing walls of said first groove and said two opposing sides of said first spline are operable to resist removal of said first spline from said first groove, and said two opposing walls of said second groove and said two opposing sides of said second spline are operable to resist removal of said second spline from said second groove.

12. An apparatus for use with framing, said apparatus comprising:

screen mesh having a marginal portion;

a lineal retainer having a major axis, a first side with a first flat spline groove, a second side with a second flat spline groove, and a third side with a third groove, wherein said second side opposes said first side, and wherein said first flat spline groove, said second flat spline groove and said third groove are parallel to said major axis;

plural fasteners driven into said framing through said lineal retainer from said third groove of said third side and between said first flat spline groove and said second flat spline groove;

a first flat spline in said first flat spline groove with said marginal portion of said screen mesh between said first flat spline and said lineal retainer; and a second flat spline in said second flat spline groove.

13. An apparatus for use with framing, said apparatus comprising:

screen mesh having a marginal portion;

a lineal retainer having a major axis, a first side with a first groove, a second side with a second groove, and a third side with a third groove, wherein said second side opposes said first side, and wherein said first groove, said second groove and said third groove are parallel to said major axis, and wherein said first groove, said second groove and said third groove are identical;

plural fasteners driven into said framing through said lineal retainer from said third groove of said third side and between said first groove and said second groove;

a first spline in said first groove with said marginal portion of said screen mesh between said first spline and said lineal retainer;

a second spline in said second groove; and a cap covering said third groove.

* * * * *